United States Patent [19]

Saito et al.

[11] 4,434,917

[45] Mar. 6, 1984

[54] TRIGGER-ACTUATED ATOMIZER

[75] Inventors: Tadao Saito; Takamitsu Nozawa; Shuzo Endo; Yoshiyuki Kakuta; Riichi Ogawa; Tetsuro Kaneuchi, all of Tokyo, Japan

[73] Assignee: Yoshino Kogyosho Co., Ltd., Tokyo, Japan

[21] Appl. No.: 267,049

[22] Filed: May 26, 1981

[51] Int. Cl.[3] ..... B67D 5/40

[52] U.S. Cl. ..... 222/383; 403/13

[58] Field of Search ..... 222/383, 382, 372, 41, 222/321; D9/409, 300; 215/31, 100 R; 239/333; 403/13, 14

[56] References Cited

U.S. PATENT DOCUMENTS

| | | | |
|---|---|---|---|
| D. 244,991 | 7/1977 | Weckman et al. | D9/300 |
| D. 255,776 | 7/1980 | Britt | D9/300 |
| 4,204,614 | 5/1980 | Reeve | 222/207 |

FOREIGN PATENT DOCUMENTS

| | | | |
|---|---|---|---|
| 38865 | 2/1975 | Canada . | |
| 38985 | 3/1975 | Canada . | |
| 43435 | 3/1978 | Canada . | |
| 2211277 | 5/1978 | Fed. Rep. of Germany | 222/321 |

*Primary Examiner*—H. Grant Skaggs

*Attorney, Agent, or Firm*—Parkhurst & Oliff

[57] ABSTRACT

A trigger-actuated atomizer pump has a first engagement member held in fitting engagement with a second engagement member on a flattened liquid container for orienting the atomizer pump securely against rotation relative to the flattened liquid container with an atomizer trigger directed in registration with the plane in which the container is flattened. The first engagement member may include a lateral projection extending remotely from the atomizer trigger so that an operator's hand can be held at the back of the thenar against the lateral projection to facilitate gripping the atomizer for fatigue-free operation in a long period of time.

8 Claims, 11 Drawing Figures

TRIGGER-ACTUATED ATOMIZER

BACKGROUND OF THE INVENTION

1. Field of the Invention

The present invention relates to a trigger-actuated atomizer including an atomizer pump attached to a flattened liquid container in an oriented position for easy triggering operation.

2. Prior Art

With trigger-actuated atomizers having a flattened liquid container, an atomizer trigger should preferably be located in an overhanging position within the plane in which the container is flattened for easy triggering operation. This is because the atomizer is single-handed with the trigger actuated by the index finger or the index and middle fingers, and if the trigger were positioned in front of a wider face of the flattened container, the finger or fingers would find difficulty in hooking and pulling the trigger effectively.

The trigger-operated atomizer pump is fixedly mounted on the flattened liquid container by a threaded cap on the pump body which is held in threaded engagement with a threaded neck of the container. However, the atomizer pump body tends to turn on the container when subjected to a strong trigger pull which the operator exerts to force out an increased amount of atomized liquid in a single atomizing operation. There has therefore been a need to secure the atomizer pump reliably in a desired position on the flattened container while using the threaded cap for attachment.

SUMMARY OF THE INVENTION

It is an object of the present invention to provide a trigger-actuated atomizer including an atomizer pump attached securely to a neck of a flattened liquid container against rotation in such a position as to facilitate triggering operation.

Another object of the present invention is to provide a trigger-actuated atomizer which can easily be carried around with one hand for fatigue-free manipulation in a number of consecutive atomizing operations.

Still another object of the present invention is to provide a trigger-actuated atomizer including a simple structure by which an atomizer pump is fixedly mounted on a flattened liquid container.

Figure 2:
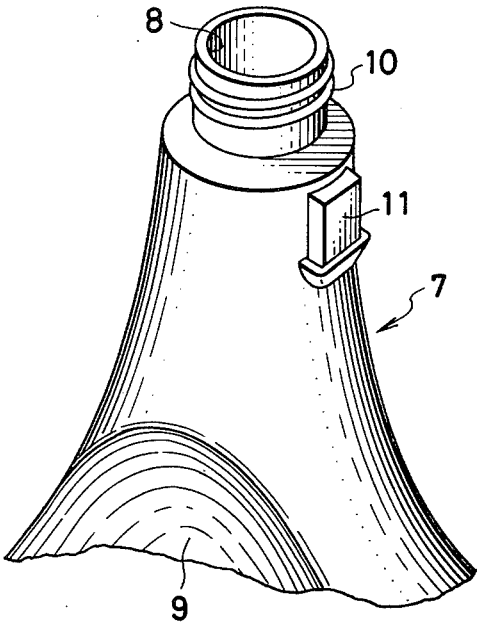
FIG. 2 is a fragmentary perspective view of a flattened container of the trigger-actuated atomizer of the first embodiment.
Figure 4:
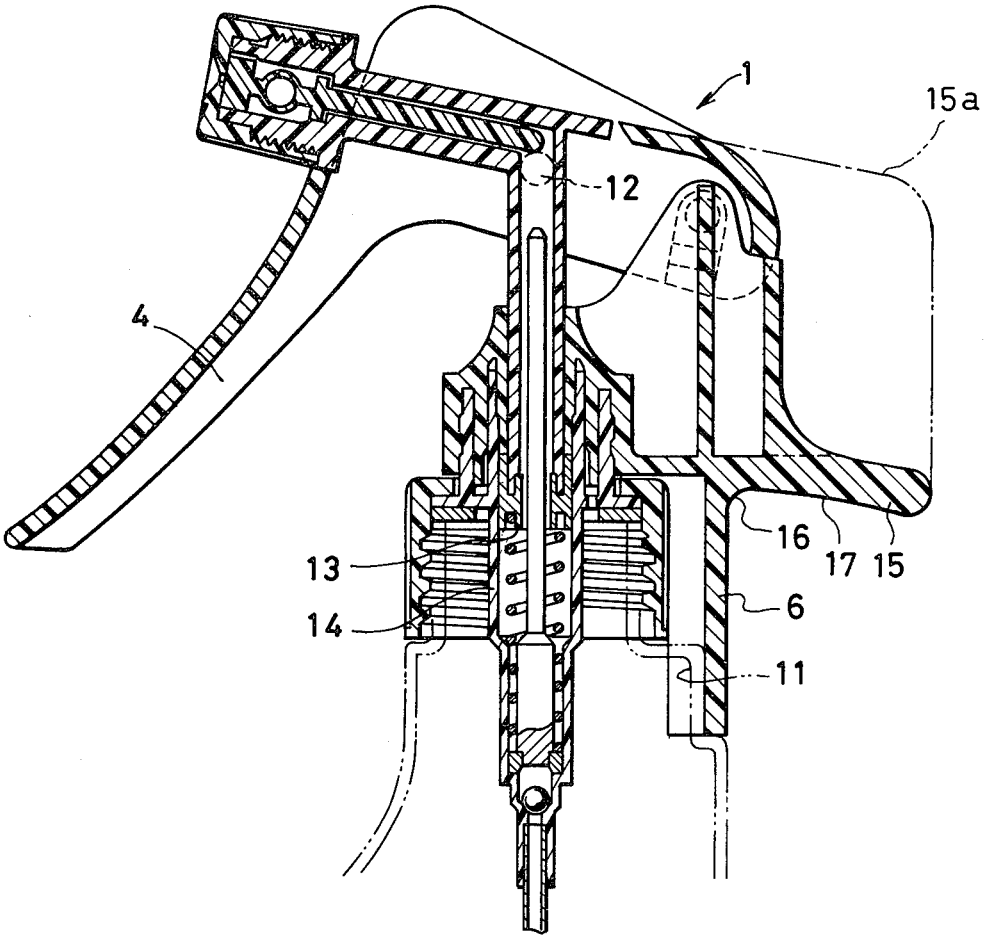
Figure 5:
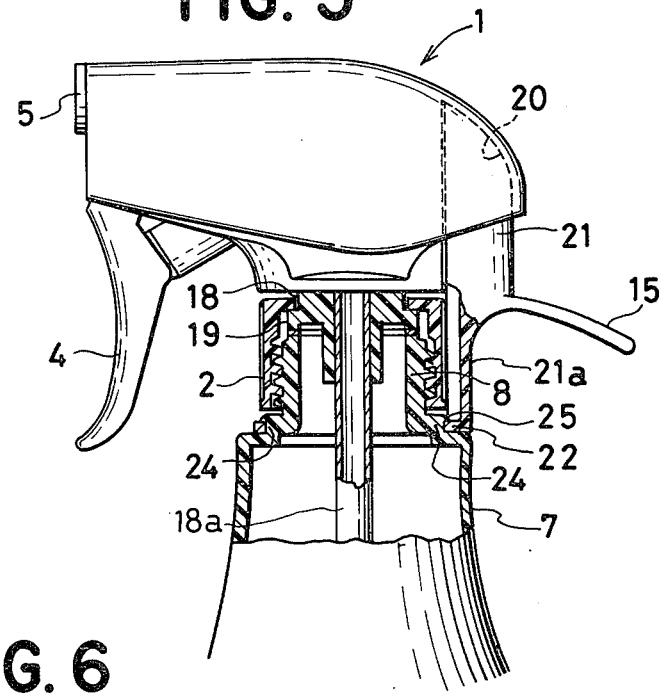
Figure 6:
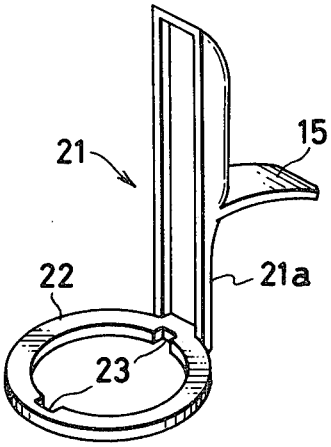
Figure 7:
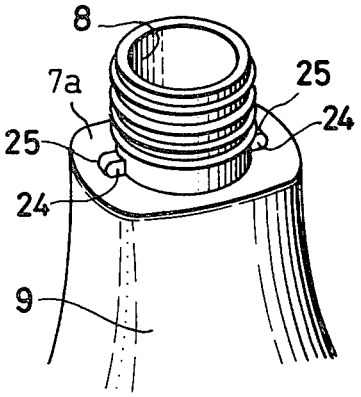
Figure 8:
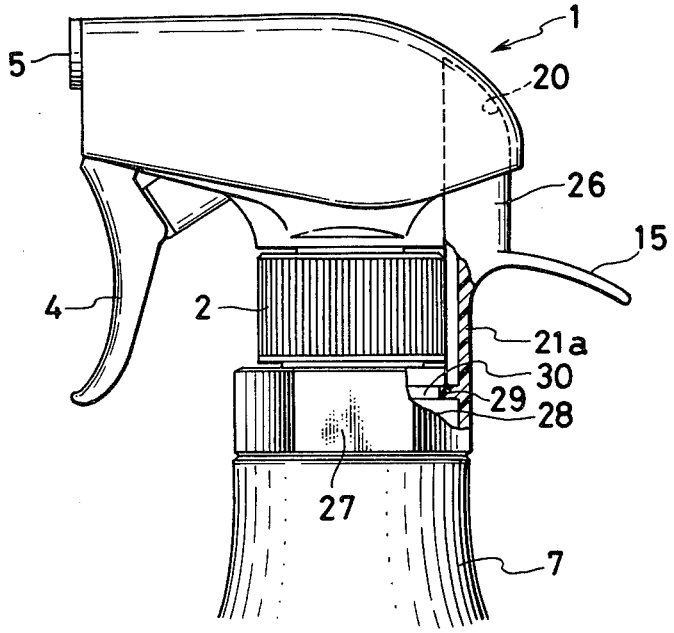
Figure 9:
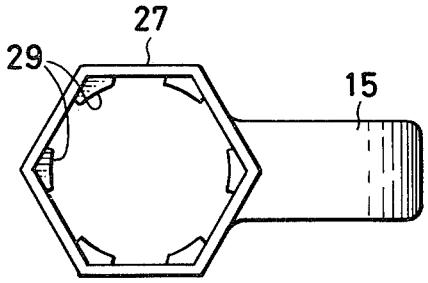
Figure 10:
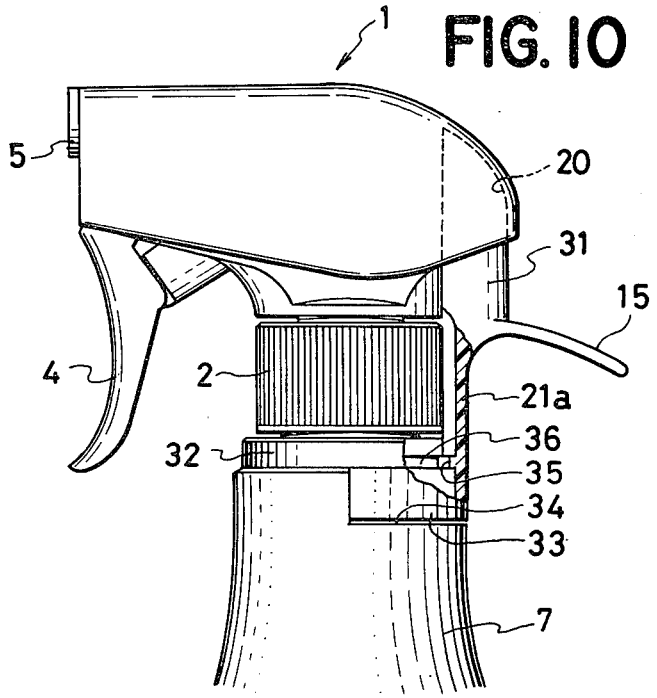
Figure 11:
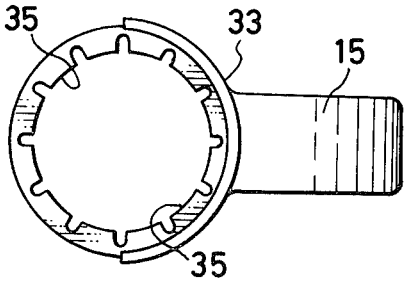

FG. 3 is a plan view, partly in cross section, of the flattened container shown in FIG. 2;

FIG. 4 is an enlarged vertical cross-sectional view of an atomizer pump of a trigger-actuated atomizer according to a second embodiment;

FIG. 5 is a fragmentary side elevational view, with parts in cross section, of a trigger-actuated atomizer according to a third embodiment;

FIG. 6 is a perspective view of a first engagement member of the trigger-actuated atomizer shown in FIG. 5;

FIG. 7 is a fragmentary perspective view of a flattened container of the trigger-actuated atomizer of FIG. 5;

FIG. 8 is a fragmentary side elevational view, partly in cross section, of a trigger-actuated atomizer in accordance with a fourth embodiment;

FIG. 9 is a bottom view of a first engagement member of the trigger-actuated atomizer shown in FIG. 8;

FIG. 10 is a fragmentary side elevational view, with parts in cross section, of a trigger-actuated atomizer according to a fifth embodiment; and FIG. 11 is a bottom view of a first engagement member of the trigger-actuated atomizer of FIG. 10.

DETAILED DESCRIPTION

Figure 1:
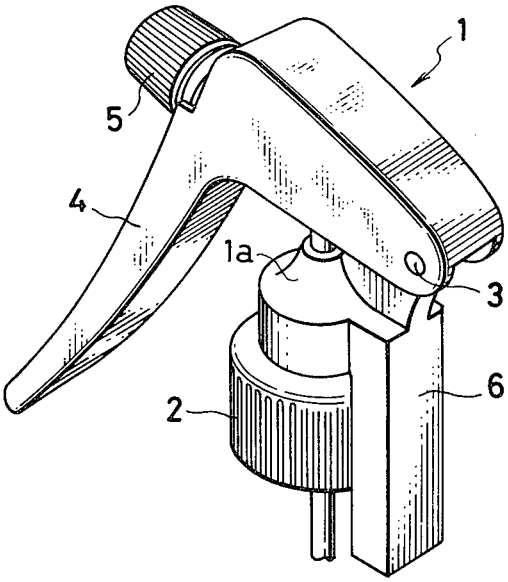
FIG. 1 is a perspective view of an atomizer pump of a trigger-actuated atomizer according to a first embodiment of the present invention.
Figure 3:
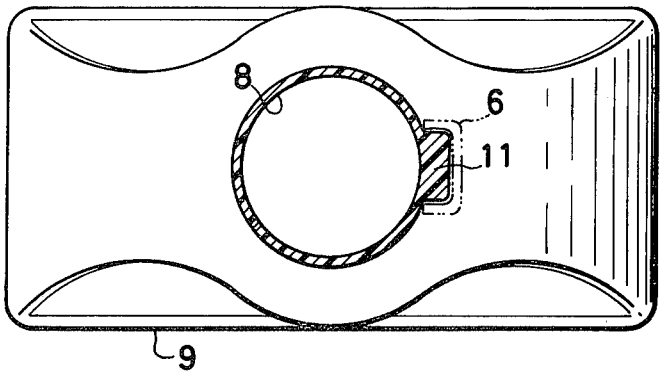

As illustrated in FIGS. 1 through 3, a trigger-actuated atomizer comprises an atomizer pump 1 including a pump body 1*a*, an internally threaded cap 2 mounted for free rotation on the pump body 1*a*, a trigger 4 directed forwardly and angularly movable about a pivot pin 3 mounted on the pump body 1*a*, and an atomizer head 5 having a nozzle for discharging atomized liquid therethrough in response to actuation of the trigger 4. A vertically elongate engagement member 6 having a channel-shaped cross section is mounted on the pump body 1*a* remotely from the trigger 4 or the atomizer head 5 across the pump body 1*a*, the engagement member 6 being closed at its upper end (FIG. 1) and open at its lower end (not shown). Although the mechanism of the atomizer pump 1 has not been shown or described in detail, it is the same as that shown in FIG. 4.

The trigger-actuated atomizer pump 1 is mounted on a flattened container 7 (FIGS. 2 and 3) for holding liquid to be atomized, the container 7 having a neck or mouth 8 and a barrel 9 that has a pair of opposite flat faces. More specifically, the container 7 is substantially pear-shaped or becomes gradually wider from the neck 8 toward the barrel 9 when viewed perpendicularly to one of the flat faces, but the container 7 has a reduced constant width when viewed in the plane in which the container 7 is flattened as shown in FIG. 3. The neck 8 is externally threaded at 10 for threaded engagement with the threaded cap 2 of the atomizer pump 1 when placed on the neck 8.

The container 7 includes an annular step disposed around and below the neck 8 and from which narrow shoulders extend divergently downwardly toward the barrel 9, and an engagement member or projection 11 located just below the step and mounted on one of the narrow shoulder, the projection 11 being of a substantially rectangular cross section as best illustrated in FIG. 3. When the atomizer body 1 and the container 7 are to be assembled together, the projection 11 is fitted complementarily into the channel-shaped engagement member 6, thereby orienting the atomizer pump 1 in a desired direction with respect to the flattened container 7, and then the threaded cap 2 is threaded onto the neck 8 until the atomizer pump 1 is secured to the flattened container 7. The trigger 4 of the pump 1 thus mounted is directed in overhanging relation to the container shoulder which is opposite to that on which the projection 11 is mounted.

While in the illustrated embodiment the projection 11 is cross-sectionally rectangular, it may be of a triangular cross section or a circular cross section and the engagement member 6 may be of a complementary cross section.

With such an arrangement, the trigger 4 can always be fixedly positioned in overhanging relation to one of the shoulders without the danger of being accidentally displaced or turned into a position which confronts one of the side faces of the container barrel 9.

A trigger-actuated atomizer according to a second embodiment as shown in FIG. 4 is basically the same in construction and operation as the trigger-actuated atomizer shown in FIGS. 1 through 3. More specifically, when a trigger 4 is pulled, a pin 12 depresses a piston 13 to pressurize a pump chamber which is defined by the piston 13 and a cylinder 14, thus causing pressurized liquid to be discharged in atomized form out of the nozzle of an atomizer head 5.

The trigger-actuated atomizer comprises an atomizer pump 1 including a channel-shaped engagement member 6 disposed in diametrically opposite relation to the trigger 4 and extending downwardly for fitting engagement with a projection 11 located adjacent to a threaded neck 8 of a flattened liquid container 7 and on one of a pair of opposite narrow shoulders of the container 7. The atomizer pump 1 is mounted securely on the container 7 by fastening a threaded cap 2 on the threaded neck 8 with the channel-shaped engagement member 6 fitted over the projection 11. The atomizer pump 1 is thus prevented from accidental rotation on the container 7 with the trigger 4 oriented securely in registration with the plane in which the container 7 is flattened.

The atomizer pump 1 includes a lateral projection 15 disposed above the engagement member 6 and extending rearwardly or remotely from the trigger 4. When the atomizer pump 1 is gripped by the operator's hand, the back of the thenar of the hand is held against the lateral projection 15 for easy grasping of the pump 1 and for fatigue reduction while handling the atomizer over a long period of time. The lateral projection 15 blends into the engagement member 6 through a rounded corner 16 having a small radius of curvature. The lateral projection is defined at its underside by a curved surface 17 having a larger radius of curvature and directed progressively downwardly toward its distal end. The lateral projection 15 thus contoured provides for neat fitting engagement with the back of the thenar of the operator's hand. The lateral projection 15 may have its upper portion extended upwardly as indicated by the two-dot-and-dash line 15*a* in FIG. 4, or otherwise shaped to meet design requirements as to desired size, balance, and appearance. The engagement member 6 and the lateral projection 15 should preferably be made integrally of synthetic resin.

The atomizer pump 1 thus constructed is advantageous in that the lateral projection 15 serves to locate the operator's hand in a best position with respect to the atomizer, and the lateral projection 15 rests on the operator's hand gripping the atomizer so that the overall weight of the atomizer can be borne by the lateral projection 15 on the hand, allowing the hand to grip the atomizer with a reduced amount of force. Furthermore, the lateral projection 15 can take up reactive forces from the operator's hand when the latter pulls the trigger 4 for effective application of forces with which the trigger 4 is squeezed and for reduction of the fatigue which the hand suffers in a number of repeated trigger pulls.

A trigger-actuated atomizer of a third embodiment illustrated in FIGS. 5 through 7 is basically the same as the trigger-actuated atomizer of the first embodiment in that actuation of a trigger 4 produces atomized liquid through a nozzle of an atomizer head 5. As shown in FIG. 5, the trigger-actuated atomizer includes an atomizer pump 1 having a downwardly projecting circular base 18 with an annular seat flange 19 extending radially outwardly therefrom and a vertical liquid suction tube 18*a* projecting centrally through and downwardly from the circular base 18. An internally threaded cap 2 is retained by the seat flange 19 for free rotation about the circular base 18. The atomizer pump 1 has in its body a downwardly opening cavity 20 positioned remotely from the atomizer head 5. A separate engagement member 21 of synthetic resin includes an upper portion fitted complementarily in the cavity 20, a post 21*a* extending downwardly from the upper portion, a ring 22 mounted on the post 21*a* at its lower end and disposed around an externally threaded neck 8 of a flattened liquid container 7, and a lateral projection 15 extending rearwardly from a substantially central portion of the engagement member 21. As shown in FIG. 6, the ring 22 has a pair of diametrically opposite recesses 23,23 opening radially inwardly toward each other.

As best illustrated in FIG. 7, the container 7 has an annular shoulder 7*a* extending around and disposed beneath the threaded neck 8, and a barrel 9 extending divergently in a flattened configuration downwardly from the shoulder 7*a*. A pair of diametrically opposite protuberances 24,24 are mounted on the annular shoulder 7*a* and each have on its upper portion an engagement nib 25 projecting radially outwardly in overhanging relation to the annular shoulder 7*a*. The recesses 24 and protuberances 25 are positioned such that the engagement member 21 is located upwardly of and in registration with one of narrow container shoulders.

In assembly, the ring 22 of the engagement member 21 is placed on the annular shoulder 7*a* with the protuberances 24,24 fitted respectively in the recesses 23,23 and the nibs 25,25 snapped over the ring 22, and the atomizer pump 1 is mounted on the threaded neck 8 with the upper portion of the engagement member 21 inserted in the cavity 20. Then, the cap 2 is threaded on the neck 8 to hold the seat flange 19 against the neck 8. Thus, the atomizer pump 1 is non-rotatably mounted on the container 7 with the engagement member 21 located in registration with one of the narrow shoulders of the container 7.

Since the engagement member 21 is structurally separate from the pump body, the post 21*a* can be made relatively thin for allowing the operator's hand to grip the atomizer with ease. Furthermore, the pump body, being separate from the engagement member 21, can easily be molded of synthetic resin.

According a fourth embodiment shown in FIGS. 8 and 9, an engagement member 26 of synthetic resin includes a post 21*a* having on its lower portion an annular polygonal wall 27 which is fitted over a peripheral polygonal wall 28 disposed beneath a threaded neck of a flattened liquid container 7. With complementary engagement between the polygonal walls 27, 28, the engagement member 26 is prevented from being turned on the flattened liquid container 7, and hence an atomizer pump body held in fitting engagement with the engagement member 26 is securely mounted on the container 7 against accidental rotation. The polygonal wall 27 of the engagement member 26 has a plurality of teeth 29 extending radially inwardly therefrom and fitted in an annual groove 30 in the container 7, which is located adjacent to the threaded neck of the container 7 and immediately above the peripheral polygonal wall 28, so that the engagement member 26 is prevented from being dislodged off the container 7. The engagement member 26 can be mounted on the container 7 by bringing the annular polygonal wall 27 axially into fitting engagement with the engagement member 26 until the teeth 29 are forcibly snapped and trapped in the annular groove 30.

FIGS. 10 and 11 illustrate a fifth embodiment of the present invention, in which an engagement member 31 of synthetic resin includes an annular wall 32 extending from a lower portion of a post 21*a* and an arcurate wall 33 projecting downwardly from the annular wall 32, the arcuate wall 33 being received in a complementary arcuate recess 34 provided in a flattened container 7 adjacent to a threaded neck thereof. The annular wall 32 has a plurality of teeth 35 projecting ability inwardly thereof into an annular groove 36 formed in the container 7 just above the arcuate recess 34. In assembly, the annular wall 32 is placed onto the container 7 until the arcuate wall 33 is fitted in the annular recess with the teeth 35 snapped and retained in the groove 36. The arcuate wall 33 received in the arcuate recess 34 prevents rotation of the engagement member 31 and the atomizer pump 1 having a body fitting over an upper portion of the engagement member 31.

What is claimed is:

1. A trigger-actuated liquid dispenser comprising:

a liquid receiving container having a body and a neck extending from said body;

means received about said neck and coupled to said body in a predetermined position for forming an engagement member which includes a projection extending outwardly from said body; and atomizer pump including a pump body, a means for coupling said pump body to said neck, means including a trigger for delivering fluid through said pump body from said container and producing an atomized fluid, and means formed in said pump body for receiving said engagement member such that said pump body is oriented in a predetermined position with respect to said container body and for preventing relative rotation between said pump body and said container body, said projection being positioned to abut against an operator's hand when gripped about said container body to operate said trigger.

2. The apparatus of claim 1 wherein said container body includes at least one protuberance coupled to said body adjacent said neck and wherein said means for forming an engagement member includes a post and a ring coupled to said post and received about said neck, said ring including at least one recess receiving said protuberance to maintain said ring in a predetermined position.

3. The apparatus of claim 1 wherein said container body is configured to have a polygonal wall adjacent said neck and wherein said means for forming an engagement member includes a post and an annular polygonal wall coupled to said post, said annular polygonal wall being coupled to receive said container body configured as a polygonal wall to maintain said engagement member in a stationary position with respect to said container body.

4. The apparatus of claim 1 wherein said container body includes an arcuate recess adjacent said neck and wherein said means for forming an engagement member includes a post, an annular wall coupled to said post, and an arcuate wall coupled to said annular wall, said arcuate wall being coupled to engage said arcuate recess to maintain said engagement member in a stationary position with respect to said container body.

5. The apparatus of claim 1 wherein said container body includes a recess and wherein said means for forming said engagement member includes a means received in said recess for retaining said engagement member on said container body.

6. A trigger-actuated liquid dispenser comprising:

a liquid receiving container having a flattened body formed by opposed flat surfaces and a threaded neck extending from said body, said container body including a protuberance coupled adjacent said neck;

means coupled to said body for forming an engagement member comprising a separate structural element including a post and a ring attached to said post, said ring including at least one slot and being positioned about said neck so that said at least one slot engages said protuberance to maintain said structural element in a predetermined position with respect to said container body to prevent relative movement therebetween; and an atomizer pump including an atomizer pump body, a means for threadably coupling said pump body to said threaded neck, means including a trigger for delivering fluid through said pump body from said container and producing an atomized fluid, and means for cooperating with said engagement member for orienting said pump body in a predetermined position with respect to said container and for preventing rotation of said pump body relative to said container.

7. A trigger-actuated liquid dispenser comprising:

a liquid receiving container having a flattened body formed by opposed flat surfaces and a threaded neck extending from said body, said container body being formed in a polygonal configuration adjacent said neck;

means coupled to said body for forming an engagement member comprising a separate structural element including a post and an annular polygonal wall attached to said post, said annular polygonal wall being positioned about said neck and coupled to receive said container body having a polygonal configuration to maintain said structural element in a predetermined position with respect to said container body to prevent relative rotational movement therebetween; and an atomizer pump including an atomizer pump body, a means for threadably coupling said pump body to said threaded neck, means including a trigger for delivering fluid through said pump body from said container and producing an atomized fluid, and means for cooperating with said engagement member for orienting said pump body in a predetermined position with respect to said container and for preventing rotation of said pump body relative to said container.

8. A trigger-actuated liquid dispenser comprising:

a liquid receiving container having a flattened body formed by opposed flat surfaces and a threaded neck extending from said body, said container body including an arcuate recess adjacent said neck;

means coupled to said body for forming an engagement member comprising a separate structural element including a post, an annular wall coupled to said post, and an arcuate wall coupled to said annular wall, said annular wall being positioned about said neck so that said arcuate wall is received by said arcuate recess to maintain said structural element in a predetermined position with respect to said container body and to prevent relative rotational movement therebetween; and an atomizer pump including an atomizer pump body, a means for threadably coupling said pump body to said threaded neck, means including a trigger for delivering fluid through said pump body from said container and producing an atomized fluid, and means for cooperating with said engagement member for orienting said pump body in a predetermined position with respect to said container and for preventing rotation of said pump body relative to said container.

* * * * *